US005803253A

United States Patent [19]

Zakarian

[11] Patent Number: 5,803,253

[45] Date of Patent: Sep. 8, 1998

[54] TOOL DISPLAY DEVICE

[75] Inventor: Arthur Zakarian, City of Industry, Calif.

[73] Assignee: Olympia Industrial Inc., City of Industry, Calif.

[21] Appl. No.: 893,186

[22] Filed: Jul. 15, 1997

[51] Int. Cl.[6] ..... A45C 11/26

[52] U.S. Cl. ..... 206/349; 206/376; 206/461; 206/471

[58] Field of Search ..... 206/349, 376, 206/377, 461, 471, 493, 495; 211/70.6; 248/309.1

[56] References Cited

U.S. PATENT DOCUMENTS

| | | | |
|---|---|---|---|
| 3,516,585 | 6/1970 | Inwood | 206/349 |
| 4,019,632 | 4/1977 | Greenlee | 206/349 |
| 4,056,190 | 11/1977 | Dix | 206/471 |
| 4,165,805 | 8/1979 | Fethke | 206/349 |
| 4,872,551 | 10/1989 | Theras | 206/349 |
| 5,595,295 | 1/1997 | Lin | 206/349 |
| 5,713,467 | 2/1998 | Kao | 206/349 |

FOREIGN PATENT DOCUMENTS

| | | | |
|---|---|---|---|
| 2652064 | 3/1991 | France | 206/349 |
| 2187714 | 9/1987 | United Kingdom | 206/349 |

*Primary Examiner*—David T. Fidei
*Attorney, Agent, or Firm*—James E. Brunton

[57] ABSTRACT

A display device for displaying adjustable wrenches in which the adjustable gripping jaws of the wrench can be manipulated relative to a generally hexagonally shaped gripping protuberance formed on the backing sheet of the device without the necessity of removing the wrench from the display device. The gripping protuberance is formed interiorly of a shaped cavity which has the general shape of the head portion of the adjustable wrench and functions to closely receive the head portion of the wrench.

17 Claims, 5 Drawing Sheets

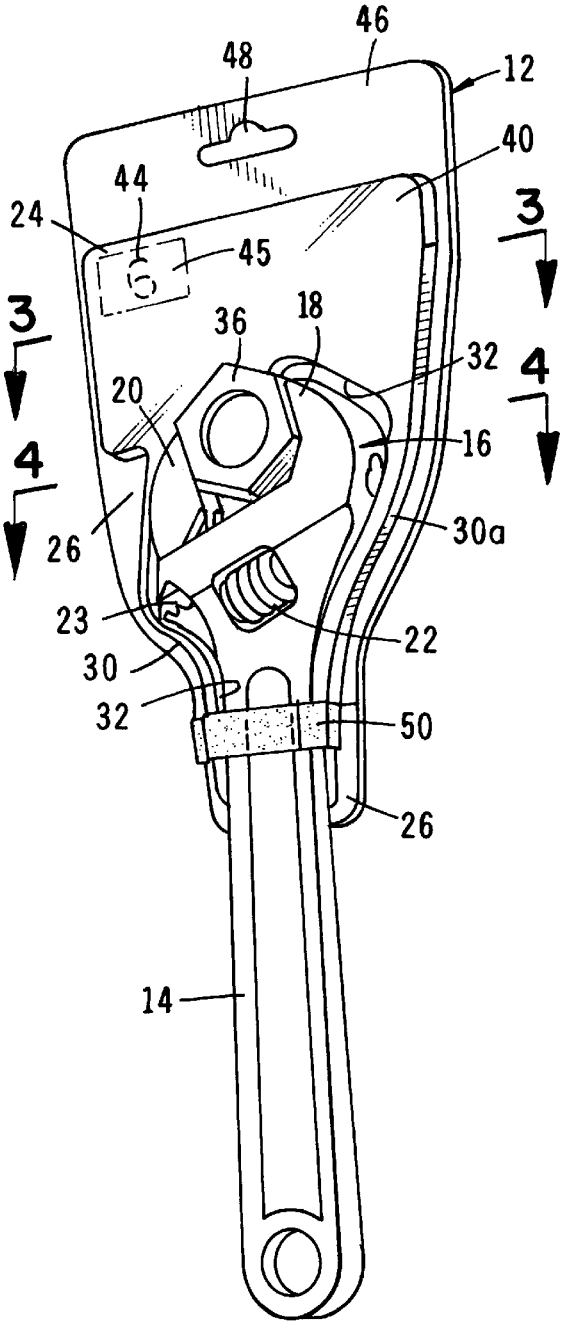
FIG. 1
FIG. 2
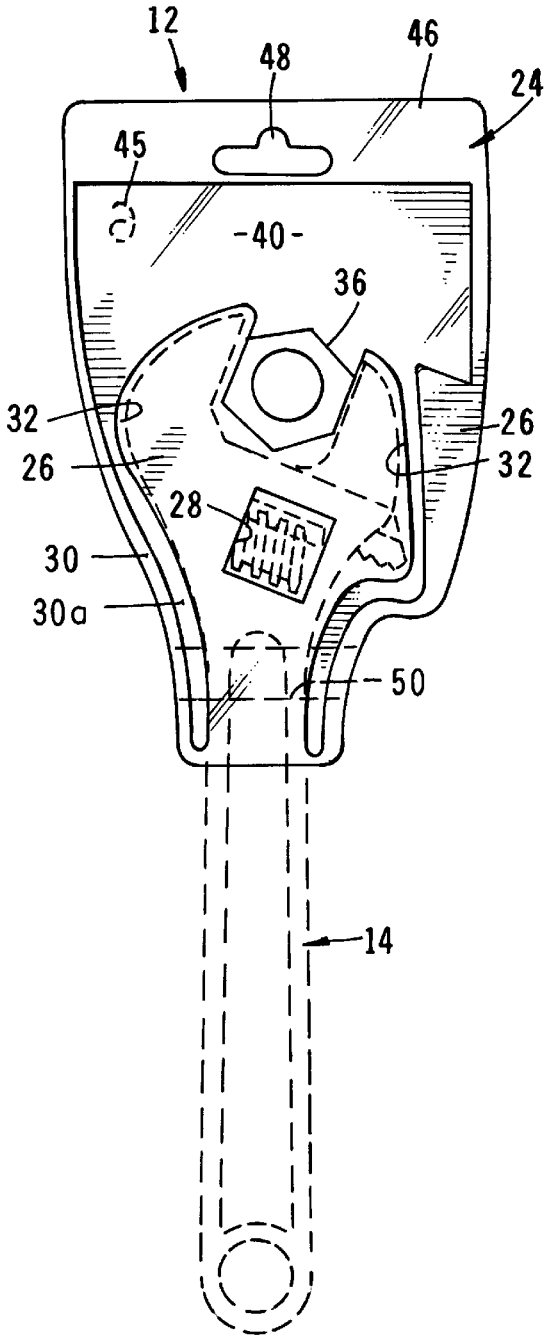

TOOL DISPLAY DEVICE

BACKGROUND OF THE INVENTION

1. Field of the Invention

The present invention relates generally to display devices for displaying tools. More particularly, the invention concerns a hanger type device for displaying for sale an adjustable wrench such as a crescent wrench.

2. Discussion of the Prior Art

Hand tools are typically displayed for sale in hardware stores and the like in display cases or in "bubble" type packages wherein the tool is encapsulated within a plastic covering that is typically affixed to a cardboard backing. The disadvantage of such packaging is that the tool cannot readily be manipulated by a potential buyer without obtaining the assistance of a sales clerk. Where adjustable tools, such as crescent wrenches and the like are being displayed, it is a sales advantage to package the tool in a manner such that it can easily be seen and also be operated by a potential buyer.

Prior art U.S. Pat. No. 4,056,190 issued to Dix exemplifies one form of "bubble" type packaging wherein the tool is encapsulated within a formed plastic enclosure. U.S. Pat. No. 4,019,632 issued to Greenlee discloses a tool handle display and hanger device for a ratchet type socket wrench tool having a ratchet head and an elongated handle. The Greenlee device is formed of a formable plastic material and has a rectangular opening at its lower portion of sufficient size to permit positioning of the ratchet head therein. The opening is defined by two parallel side portions and a bottom portion, the bottom portion having a semi-cylindrical hump formed therein with an inner diameter corresponding to the diameter of the elongated handle.

As will be appreciated from the discussion which follows, the packaging device of the present invention has a novel feature comprising a generally hexagonally shaped protuberance which is integrally formed with the backing component of the device. This protuberance is strategically positioned so that the adjustable jaws of the crescent wrench being displayed can circumscribe the protuberance and be moved into gripping engagement therewith in much the same manner as the tool can be used to grip a hexagonal nut or bolt head. With this novel arrangement, the potential purchaser can manipulate the tool in a manner to move the adjustable jaws into and out of engagement with the protuberance without the necessity of removing the tool from the display device.

SUMMARY OF THE INVENTION

It is an object of the present invention to provide a display device for displaying adjustable wrenches in which the adjustable gripping jaws of the wrench can be manipulated relative to a gripping protuberance formed on the backing sheet of the device without the necessity of removing the wrench from the display device.

Another object of the invention is to provide a display device of the aforementioned character in which the adjustable jaw portions of the wrench being displayed are maintained in engagement with a backing panel with the handle portion of the wrench depending downwardly from the backing panel.

Another object of the invention is to provide a display device as defined in the preceding paragraph in which the backing panel includes a handle engaging strap which overlays a portion of the handle of the tool so as to maintain the shaped head portion of the wrench in engagement with the backing panel while the adjustable jaws are being manipulated.

Another object of the invention is to provide a display device of the character described in which the backing panel includes a generally planar portion that permits descriptive information concerning the tool to be prominently displayed.

Another object of the invention is to provide a display device as described in the preceding paragraph in which the backing panel of the device is provided with an aperture to permit the display device to be hung from a hook or rod extending from a fixed display board.

BRIEF DESCRIPTION OF THE DRAWINGS

FIG. 1 a generally perspective view of one form of the display device of the present invention for displaying an adjustable wrench.

FIG. 2 is a top plan view of the display device showing the adjustable wrench in dotted lines.

DISCUSSION OF THE INVENTION

Figure 3:
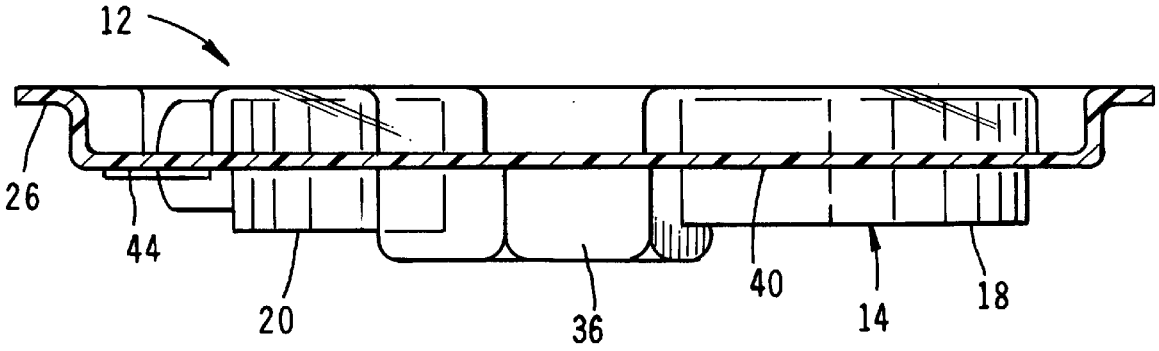
FIG. 3 is a cross-sectional view taken along lines 3—3 of FIG. 1.

Referring to the drawings and particularly to FIG. 1, one form of the display device of the present invention is there illustrated and generally designated by the numeral 12. The device is specially designed for displaying an adjustable wrench such as a crescent wrench 14 that includes fixed and movable gripping jaws 18 and 20 respectively and a rotatable adjustment member 22 which cooperates with a rack 23 for adjusting the spacing between gripping jaws 18 and 20.

Figure 4:
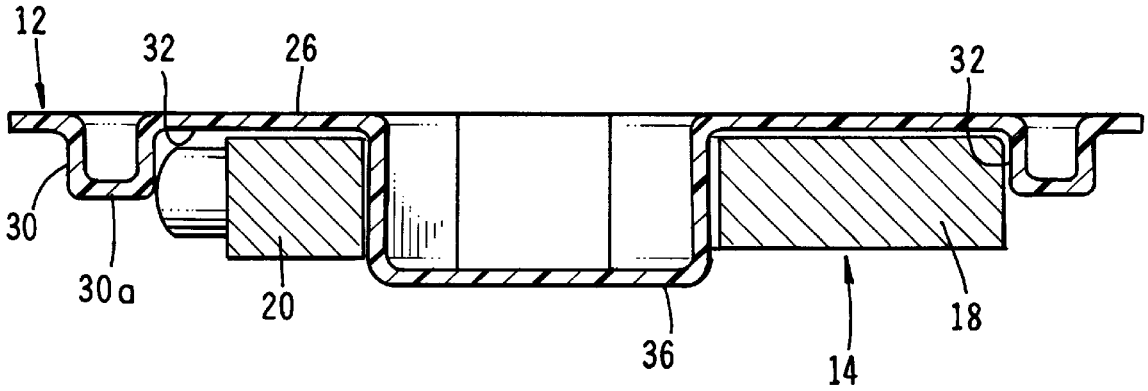
FIG. 4 is a cross-sectional view taken along lines 4—4 of FIG. 1.

In the form of the invention shown in the drawings, the display device comprises a display platform 24 formed of a thin, rigid formable plastic material. As best seen by referring to FIG. 2, the display platform 24 includes a base wall 26 having an opening 28 for receiving the adjustment member 22 of the shaped head portion 16 of the crescent wrench. Formed on base wall 26 is an upstanding curved side wall 30 (FIG. 4) which cooperates with base wall 26 to define a cavity 32 having the general shape of the shaped head portion 16 of the adjustable wrench.

A very important feature of the display device of the present invention comprises an upstanding, generally hexagonally shaped protuberance 36 formed on base wall 26. Protuberance 36 is disposed within cavity 32 and is uniquely engagable by the gripping jaws of the crescent wrench in much the same manner that the jaws would grip a hexagonal nut or bolt during actual use of the tool. With this novel construction, a potential purchaser of the crescent wrench can manipulate the adjustment mechanism 22 to open and close jaws 18 and 20 about the multisided protuberance 36 in a manner to experience the "feel" of the adjustment means of the tool.

Another important aspect of the display device of the present invention is the provision of a display wall 40, which is connected to base wall 26 and extends therefrom in the manner shown in FIGS. 1 and 3. In the form of the invention shown in the drawings, curved wall 30 includes a top surface, or wall 30*a*, which is generally co-planar with display wall 40. Display wall 40 functions to permit indicia-carrying labels to be affixed to the display device as, for example, label 44. Label 44 carries advertising and informational indicia such as indicia 45 identifying the size of the adjustable wrench being displayed on the display platform.

Another important feature of the display device of the invention comprises a generally planar apertured wall 46 within which a hook receiving aperture 48 is formed. Aperture 48 is specifically designed to receive hook-like elements of the character typically used on display boards such as peg boards and the like for displaying tools and like articles.

Forming still another important aspect of the apparatus of the invention is capture means maintaining the wrench in position within cavity 32. In the embodiment of the invention shown in the drawings, the capture means is provided in the form of an elongated strap 50 which is connected proximate its end portions to base wall 26 in a manner so that a portion of the strap overlays a portion of cavity 32. More particularly, as best seen in FIG. 1, the central portion of strap 50 overlays the portion of the cavity which receives that part of the adjustable wrench located proximate the junction of the elongated handle 14 and the shaped head portion 16.

In the preferred form of the invention, base wall 26, side wall 30, multi-sided protuberance 36, display wall 40 and apertured wall 46 are all formed in one operation from a single sheet of formable plastic sheet material. In this regard several different types of plastic material can be used to construct the display device and the method of forming the plastic into the desired shape is well known by those skilled in the art.

In summary, as best seen in FIG. 1, when the adjustable wrench is in position within cavity 32 and strap 50 overlays the upper portion of handle 14, the adjustable wrench is securely retained within cavity 32. By tightening jaw 20 relative to fixed jaw 18, the gripping jaws can be moved into secure gripping engagement with protuberance 36 which further assists in holding the adjustable wrench being displayed in position within cavity 32 and securely in engagement with base wall 26. Since with this novel construction, the head portion of the adjustable wrench is exposed, the adjustment means 22 can be easily manipulated by a potential purchaser in the manner previously described.

When the adjustable wrench is secured in position within cavity 32, the wrench along with the display device can be attractively displayed on a display board by inserting a display hook within aperture 48 so that the assemblage depends downwardly from the hook shaped member.

Referring next to FIGS. 5 through 10, an alternate form of the display device of the invention is there illustrated and generally designated by the numeral 55. This latter device is also designed for displaying an adjustable wrench such as a crescent wrench 57 that includes fixed and movable gripping jaws 59 and 61 respectively and a rotatable adjustment member 63 which cooperates with a rack 65 for adjusting the spacing between gripping jaws 59 and 61.

In this latest embodiment of the invention, the display device comprises a display platform 67 formed of a thin, rigid formable plastic material. As best seen by referring to FIG. 5, the display platform 67 includes a base wall 69 having an opening 71 for receiving the adjustment member 63 of the shaped head portion 73 of the crescent wrench. Formed on base wall 69 is an upstanding curved side wall 75 (FIG. 5) which cooperates with base wall 69 to define a cavity 77 having the general shape of the shaped head portion 73 of the adjustable wrench.

As in the earlier described embodiment, a novel and important aspect of the display device of this latest form of the invention comprises an upstanding, generally hexagonally shaped protuberance 79 formed on base wall 69. Protuberance 79 is disposed within cavity 77 and is uniquely engagable by the gripping jaws of the crescent wrench in much the same manner that the jaws would grip a hexagonal nut or bolt during actual use of the tool. This novel construction enables a potential purchaser of the crescent wrench to realistically manipulate the adjustment mechanism 63 to open and close jaws 57 and 59 about the multisided protuberance 79 in a manner to experience the "smoothness of operation" of the adjustment means of the tool.

Figure 5:
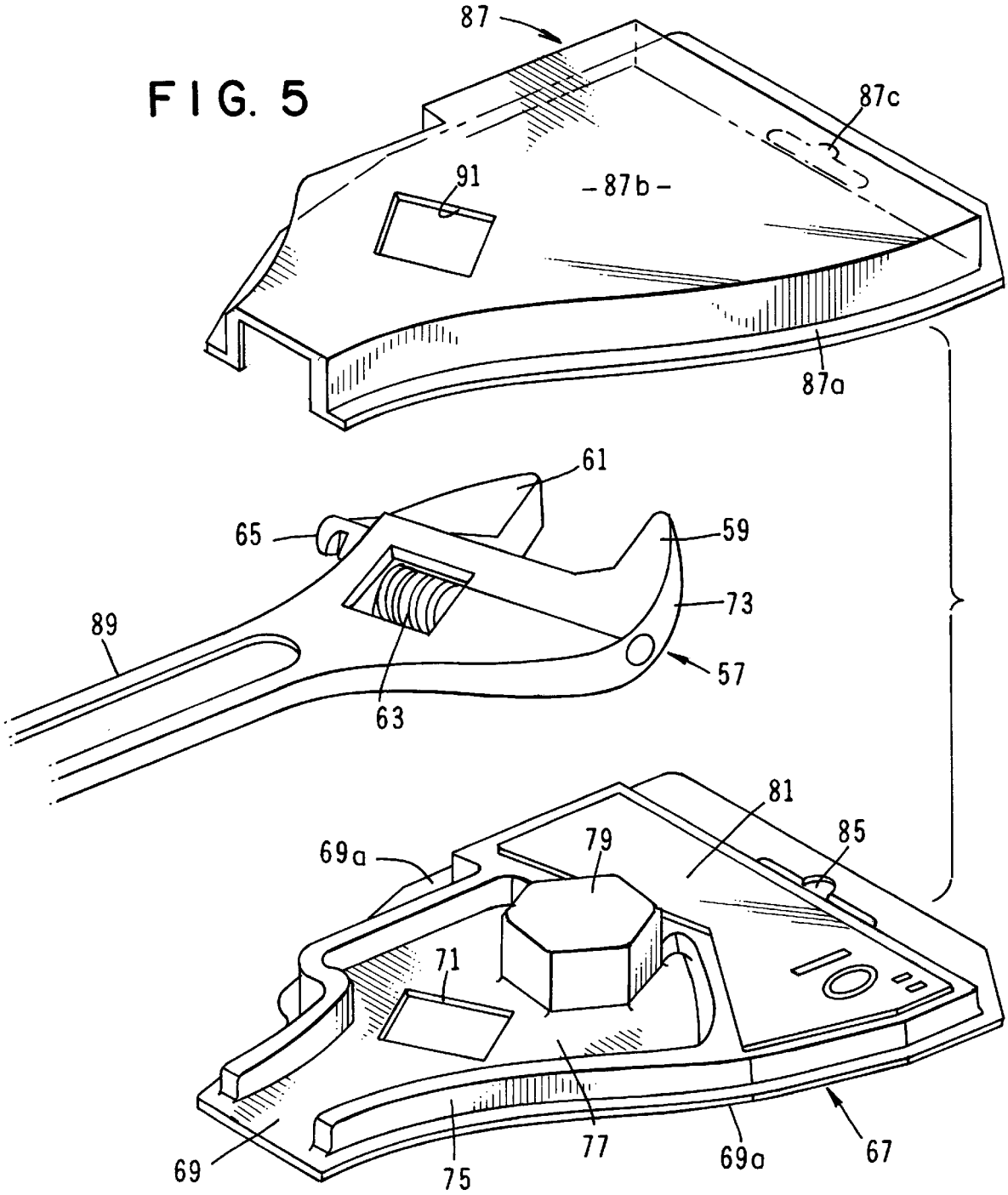
FIG. 5 is a generally perspective, exploded view of an alternate form o the display device of the present invention for displaying an adjustable wrench.
Figure 6:
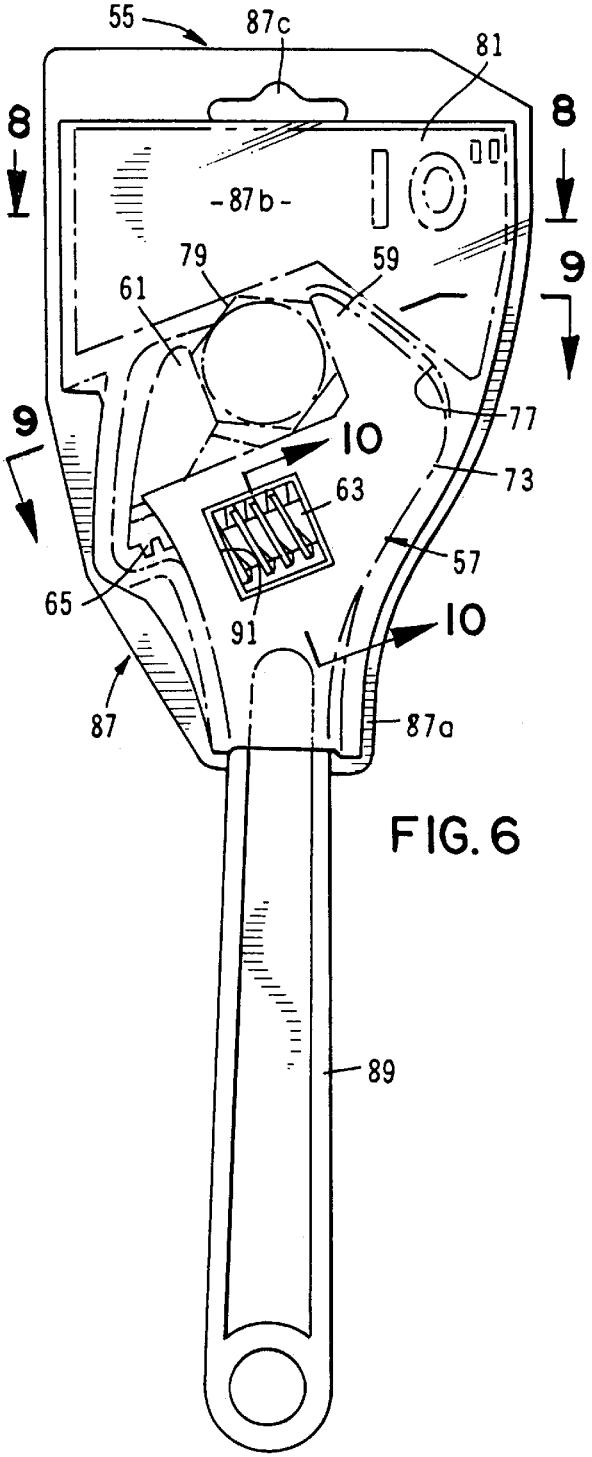
FIG. 6 is a top plan view of the display device illustrated in FIG. 5 showing the adjustable wrench in dotted lines.
Figure 7:
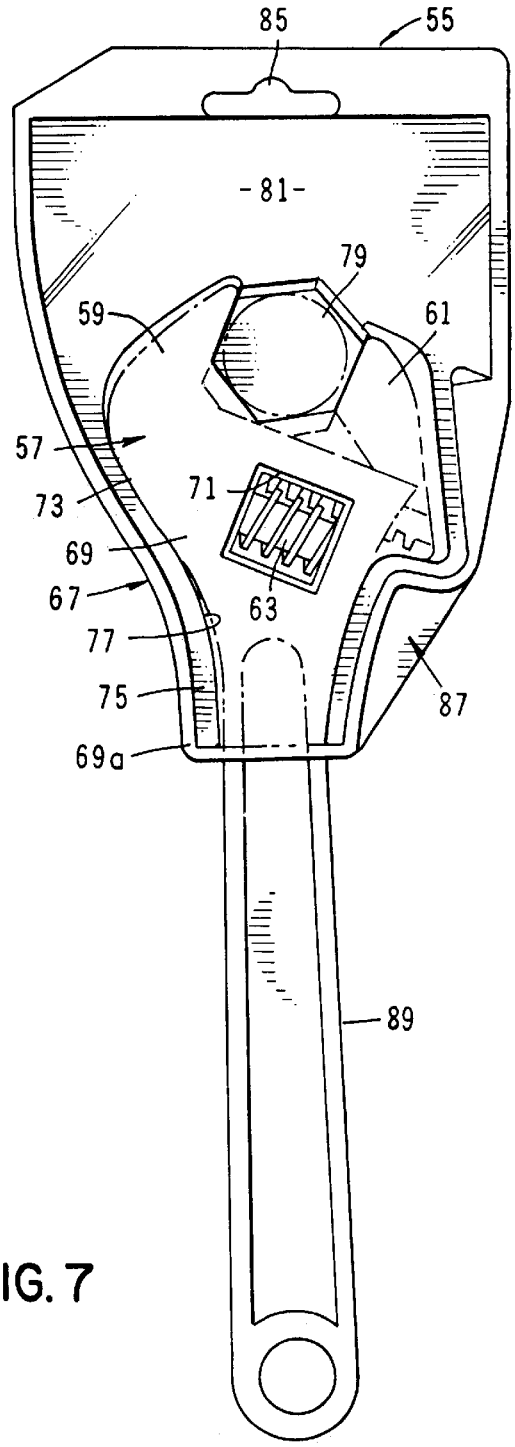
FIG. 7 is a bottom view of the display device shown in FIG. 5.
Figure 8:
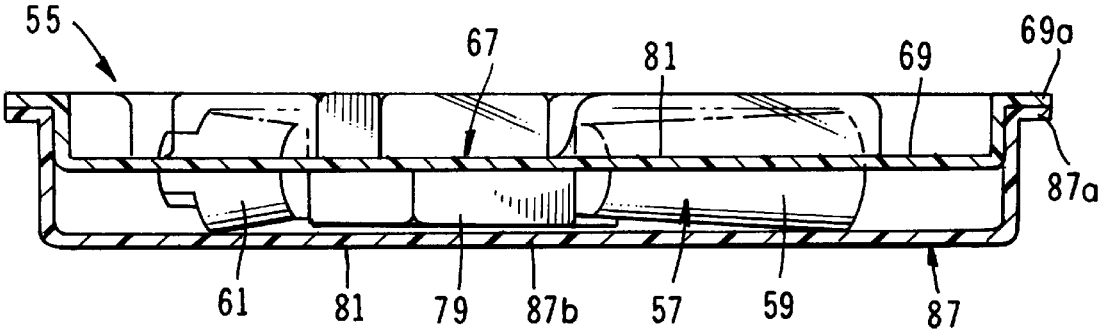
FIG. 8 is a cross-sectional view taken along lines 8—8 of FIG. 6.
Figure 9:
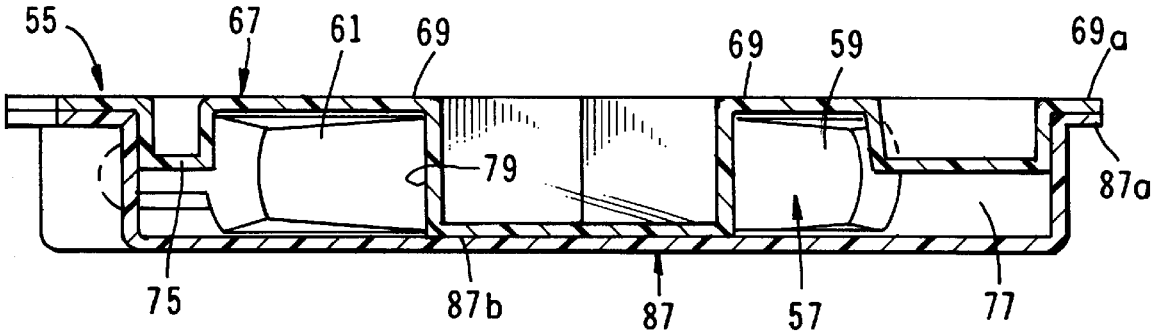
FIG. 9 is a cross-sectional view taken along lines 9—9 of FIG. 6.
Figure 10:
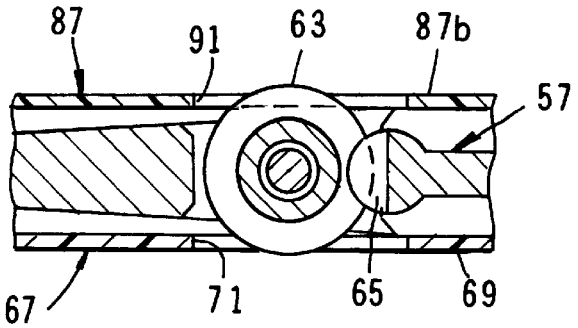
FIG. 10 is a cross-sectional view taken along lines 10—10 of FIG. 6.

Another important aspect of this latter form of the display device of the invention is the display wall 81, which is connected to base wall 69 and extends therefrom in the manner best seen in FIG. 5. As before, the display wall 81 functions to permit identifying indicia to be imprinted on the wall or on labels affixed to the wall as, for example, the indicia shown as the number "10". Other advertising and informational indicia can, of course, also be displayed on display platform 81.

Also provided near the top of base wall 69 is a hook receiving aperture 85. As before, aperture 85 is designed to receive hook-like elements of the character typically used on display boards such as peg boards and the like for displaying tools and like articles.

Forming still another important feature of the apparatus of the alternate form of the invention shown in FIGS. 5 though 10 is a novel capture means for retaining the wrench within cavity 77. The capture means here comprises a cover member 87 which overlays base wall 69 and is connected to the periphery 69*a* thereof. In the embodiment of the invention shown in the drawings, the important capture means or cover comprises a strategically shaped formed plastic cover 87 having the configuration best seen in FIG. 5. As can be seen by referring to FIGS. 5, 6, and 9, cover 87 overlays both the display wall 81 and the cavity 77 which receives that part of the adjustable wrench located proximate the junction of the elongated handle 89 and the shaped head portion 73.

Cover 87 which is preferably substantially transparent, includes a peripheral portion 87*a* which mates with and is affixed to periphery 69*a* of base wall 69, and upraised central portion 87*b* and a hook-receiving aperture 87*c* which overlays and indexes with aperture 85 in base wall 69. Importantly, cover 87 also has formed therein an adjustment member receiving aperture 91 which closely receives the adjustment member 63 of the wrench when the cover is interconnected with base 69.

In the preferred form of the invention, base wall 69, curved wall 75, multi-sided protuberance 79, and display wall 81 are all formed in one operation from a single sheet of formable plastic sheet material. Similarly, cover 87 is also preferably formed in a single operation form a sheet of transparent plastic material. In this regard, several different types of plastic material can be used to construct the display device and the method of forming the plastic into the desired shape is well known by those skilled in the art.

In summary, as best seen in FIGS. 6 through 10, when the adjustable wrench 57 is in position within cavity 77 and when cover 87 overlays and is connected to the platform 67 in the manner shown in the drawings, the adjustable wrench is securely retained within cavity 77 with the head portion 73 encapsulated within the assembly made up of platform 69 and cover 87. By tightening jaw 61 relative to fixed jaw 59, the gripping jaws can be moved into secure gripping engagement with protuberance 79 which further assists in holding the adjustable wrench being displayed in position within the cover, platform assemblage. However, since adjustment member 63 extends through openings 71 and 91 (see FIGS. 5 and 10), the adjustment means or member 63 can be easily manipulated by a potential purchaser in the manner previously described.

When the adjustable wrench is secured in position between platform 69 and cover 87, the wrench along with the display device can be attractively displayed on a display board by inserting a display hook within aperture 85 so that the assemblage depends downwardly from the hook shaped member.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A display device for displaying an adjustable wrench having an elongated handle, a shaped head portion connected to the handle, the head portion including gripping jaws and an adjustment member for adjusting the spacing between the gripping jaws, said display device comprising:

(a) a display platform formed of a thin rigid formable plastic material, said display platform having:
  (i) a base wall having an opening therein for receiving the adjustment member of the shaped head portion of the adjustable wrench;
  (ii) an upstanding curved side wall formed on said base wall, said curved side wall cooperating with said base wall to define a shaped cavity having the general shape of the shaped head portion of the adjustable wrench;
  (iii) an upstanding, multisided protuberance disposed within said cavity for engagement by the gripping jaws of the crescent wrench; and (b) capture means for retaining the adjustable wrench with said cavity of said display platform.

2. A display device as defined in claim 1 in which said display platform further includes a display wall connected to and extending from said curved side wall.

3. A display device as defined in claim 2 in which said display platform further includes an apertured wall connected to said display wall and extending therefrom.

4. A display device as defined in claim 3 in which said curved side wall includes an upper surface and in which said display wall and said upper surface of said side wall are substantially coplanar.

5. A display device as defined in claim 4 in which said base wall, said multisided protuberance, said display wall and said apertured wall are formed from a single sheet of formable plastic material.

6. A display device as defined in claim 5 in which said capture means comprises a strap connected to said display platform and overlaying a portion of said cavity.

7. A display device as defined in claim 5 in which said capture means comprises a cover overlaying said display platform.

8. A display device as defined in claim 7 in which said cover is provided with an adjustment member receiving opening.

9. A display device for displaying an adjustable crescent wrench having an elongated handle, a pair of adjustable gripping jaws connected to the handle, and an adjustment member for adjusting the gripping jaws, said display device comprising:

(a) a display platform formed of a thin rigid formable plastic material, said display platform having:
  (i) a generally planar base wall having an opening therein to receive a portion of the adjusting member;
  (ii) an upstanding, curved side wall formed on said base wall and cooperating therewith to define a generally crescent shaped cavity;
  (iii) an upstanding, multisided protuberance formed on said base wall for gripping engagement by the gripping jaws of the adjustable crescent wrench; and
  (iv) a generally planar display wall connected to said upstanding curved side wall and extending therefrom; and
  (v) a generally planar apertured wall connected to and extending outwardly from said display wall; and (b) capture means for maintaining the crescent wrench within said cavity of said display platform.

10. A display device as defined in claim 9 in which said capture means comprises a strap connected to said base wall and overlaying a portion of said crescent shaped cavity.

11. A display device as defined in claim 9 in which said capture means comprises a cover overlaying and connected to said display platform, said cover having an adjustment member receiving opening for receiving the adjustment member of the wrench.

12. A display device as defined in claim 9 in which said base wall, said multisided protuberance, said display wall and said apertured wall are all formed from a single sheet of formable plastic material.

13. A display device as defined in claim 12 in which said upstanding, multi-sided protuberance is generally hexagonal in shape.

14. A display device for displaying an adjustable crescent wrench having an elongated handle, a pair of adjustable gripping jaws connected to the handle, and an adjustment member for adjusting the gripping jaws, said display device comprising:

(a) a display platform formed as a single piece from a sheet of thin, rigid formable plastic material, said display platform having:
  (i) a generally planar base wall having an opening therein to receive a portion of the adjusting member;

(ii) an upstanding, curved side wall formed on said base wall and cooperating therewith to define a generally crescent shaped cavity;

(iii) an upstanding, multisided protuberance formed on said base wall for gripping engagement by the gripping jaws of the adjustable crescent wrench; and (iv) a generally planar display wall connected to said upstanding curved side wall and extending therefrom; and (v) a generally planar apertured wall connected to and extending outwardly from said display wall; and (b) capture means for maintaining the crescent wrench within said cavity of said display platform.

15. A display device as defined in claim 14 in which said capture means comprises a strap connected to said base wall and overlaying a portion of said crescent shaped cavity.

16. A display device as defined in claim 14 in which said capture means comprises a substantially transparent cover member overlaying and connected to said display platform.

17. A display device as defined in claim 16 in which said cover member has a central portion and a peripheral portion circumscribing said central portion and being connected to said display platform, said central portion having an adjustment member receiving opening for closely receiving the adjustment member of the wrench.

* * * * *